US009138625B2

(12) United States Patent
Chung

(10) Patent No.: US 9,138,625 B2
(45) Date of Patent: Sep. 22, 2015

(54) BALL BAT

(71) Applicant: Min-Ju Chung, Taichung (TW)

(72) Inventor: Min-Ju Chung, Taichung (TW)

( * ) Notice: Subject to any disclaimer, the term of this patent is extended or adjusted under 35 U.S.C. 154(b) by 10 days.

(21) Appl. No.: 14/154,253

(22) Filed: Jan. 14, 2014

(65) Prior Publication Data

US 2015/0094174 A1 Apr. 2, 2015

(30) Foreign Application Priority Data

Sep. 27, 2013 (CN) ..... 2013 2 0604621

(51) Int. Cl.
*A63B 59/06* (2006.01)

(52) U.S. Cl.
CPC ..... *A63B 59/06* (2013.01)

(58) Field of Classification Search
CPC . A63B 59/06; A63B 59/0014; A63B 2209/02
USPC ..... 473/457, 519, 520, 564–568, 44
See application file for complete search history.

(56) References Cited

U.S. PATENT DOCUMENTS

| | | | | | |
|---|---|---|---|---|---|
| 310,248 | A * | 1/1885 | Brown | 473/564 |
| 795,815 | A * | 8/1905 | Burrows | 473/564 |
| 1,063,563 | A * | 6/1913 | May | 473/564 |
| 2,458,919 | A * | 1/1949 | Marsden | 473/564 |
| 4,844,460 | A * | 7/1989 | Mitchell et al. | 473/564 |
| 5,620,179 | A * | 4/1997 | MacKay, Jr. | 473/564 |
| 6,334,823 | B1 * | 1/2002 | Holman | 473/564 |
| 6,767,299 | B1 * | 7/2004 | Chang | 473/564 |
| 6,899,648 | B2 * | 5/2005 | Chang | 473/564 |
| 8,795,107 | B2 * | 8/2014 | McDonald | 473/564 |
| 8,894,518 | B2 * | 11/2014 | Chung | 473/564 |
| 9,005,056 | B2 * | 4/2015 | Pegnatori | 473/564 |
| 2001/0008854 | A1 * | 7/2001 | Costain et al. | 473/46 |
| 2004/0029660 | A1 * | 2/2004 | Chen et al. | 473/564 |
| 2004/0162169 | A1 * | 8/2004 | Gallagher | 473/564 |
| 2005/0059515 | A1 * | 3/2005 | Chang | 473/564 |
| 2007/0072710 | A1 * | 3/2007 | Lo | 473/564 |
| 2007/0072711 | A1 * | 3/2007 | Mallas | 473/564 |
| 2007/0232422 | A1 * | 10/2007 | Chang | 473/564 |
| 2008/0308187 | A1 * | 12/2008 | Dill | 144/350 |
| 2009/0275428 | A1 * | 11/2009 | Ikeda et al. | 473/564 |
| 2011/0015006 | A1 * | 1/2011 | MacDougall | 473/564 |
| 2011/0015007 | A1 * | 1/2011 | MacDougall | 473/564 |
| 2011/0015008 | A1 * | 1/2011 | MacDougall | 473/564 |
| 2011/0312452 | A1 * | 12/2011 | Verrengia et al. | 473/564 |
| 2014/0073463 | A1 * | 3/2014 | Chung | 473/564 |
| 2014/0080642 | A1 * | 3/2014 | Epling et al. | 473/564 |

* cited by examiner

*Primary Examiner* — Mark Graham
(74) *Attorney, Agent, or Firm* — Trop, Pruner & Hu, P.C.

(57) ABSTRACT

A ball bat includes a bat body and a core unit. The bat body has a barrel section, a knob section, and a handle section. The barrel section has an upper receiving space defined by a space-defining surface. The handle section interconnects the barrel section and the knob section. The bat body includes a plurality of wooden pieces, each having a connecting region that is formed with an upper groove as a portion of the upper receiving space. The space-defining surface is formed with a plurality of adhesive-receiving grooves in spatial communication with the upper receiving space. The core unit has a tube disposed in the upper receiving space and adhered to the space-defining surface.

5 Claims, 6 Drawing Sheets

BALL BAT

CROSS-REFERENCE TO RELATED APPLICATION

This application claims priority of Chinese Patent Application No. 201320604621.1, filed on Sep. 27, 2013.

BACKGROUND OF THE INVENTION

1. Field of the Invention

The invention relates to a bat, more particularly to a ball bat.

2. Description of the Related Art

Chinese Patent Application publication No. CN202802681U discloses a conventional ball bat that includes a bat body, a first tube and a second tube. The bat body extends along a main axis and has a barrel section formed with an upper receiving space, a knob section opposite to the barrel section, and a handle section interconnecting the barrel section and the knob section and formed with a lower receiving space. The bat body is integrally formed by a plurality of angularly-disposed wooden pieces extending along the main axis. Each of the wooden pieces has a connecting region that is formed with an upper groove as a portion of the upper receiving space, a lower groove as a portion of the lower receiving space, and a separating part separating the upper groove from the lower groove. The first tube is disposed in the upper receiving space, and the second tube is disposed in the lower receiving space. By utilizing the first and second tubes, the weight of the conventional ball bat can be reduced. The first and second tubes are adhered to the bat body in the upper and lower receiving spaces using adhesives, so that each of the upper and lower receiving spaces needs to be a bit larger than the dimension of a respective one of the first and second tubes in order to prevent excess amount of the adhesives from leaking out of the upper and lower receiving spaces. However, such a configuration may cause improper positioning of the first and second tubes in the upper and lower receiving spaces and adversely affect the balance and hitting performance of the conventional ball bat.

Chinese Patent Application Publication No. CN202301855U discloses another conventional ball bat including a hollow handle segment, a wooden barrel segment and a reinforcing segment. The handle segment has a handle section, a connecting section that has an outer diameter smaller than that of the handle section, and an abutment section that is disposed between the handle and connecting sections. The barrel segment has an abutment end section, a top end section that is opposite to the handle section of the handle segment, and an insertion hole that extends from the abutment end section toward the top end section. The connecting section is inserted into the insertion hole. The abutment end section of the barrel segment abuts against the abutment section of the handle segment. The reinforcing segment is sleeved on the abutment end section. The barrel segment also has a retaining hole retaining a core tube component. While the connecting section and the core tube are retained respectively in the insertion hole and the retaining hole using adhesives, the positioning problem may also occur like the aforementioned conventional ball bat.

U.S. Pat. No. 6,767,299 discloses yet another conventional ball bat that includes a wooden bat body having a center through hole, a tubular core member fitted into the center through hole of the bat body, and a weight mounted inside the tubular core member. Although there is no method disclosed in this patent illustrating how to retain the tubular core member in the wooden bat body, people having ordinary skill in the art will appreciate that the same positioning problem will occur if the method of using adhesives to assemble the conventional ball bat is adopted.

SUMMARY OF THE INVENTION

Therefore, the object of the present invention is to provide a ball bat that may alleviate the aforementioned drawback of the prior art.

Accordingly, a ball bat of the present invention includes a bat body and a core unit. The bat body extends along a main axis and has a barrel section, a knob section, and a handle section. The barrel section has an upper receiving space that is defined by a space-defining surface. The knob section is opposite to the barrel section along the main axis. The handle section interconnects the barrel section and the knob section. The bat body includes a plurality of angularly-disposed wooden pieces that extend along the main axis. Each of the wooden pieces has a connecting region that is formed with an upper groove as a portion of the upper receiving space. The space-defining surface is formed with a plurality of adhesive-receiving grooves that are in spatial communication with the upper receiving space.

The core unit has a tube disposed in the upper receiving space and adhered to the space-defining surface.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
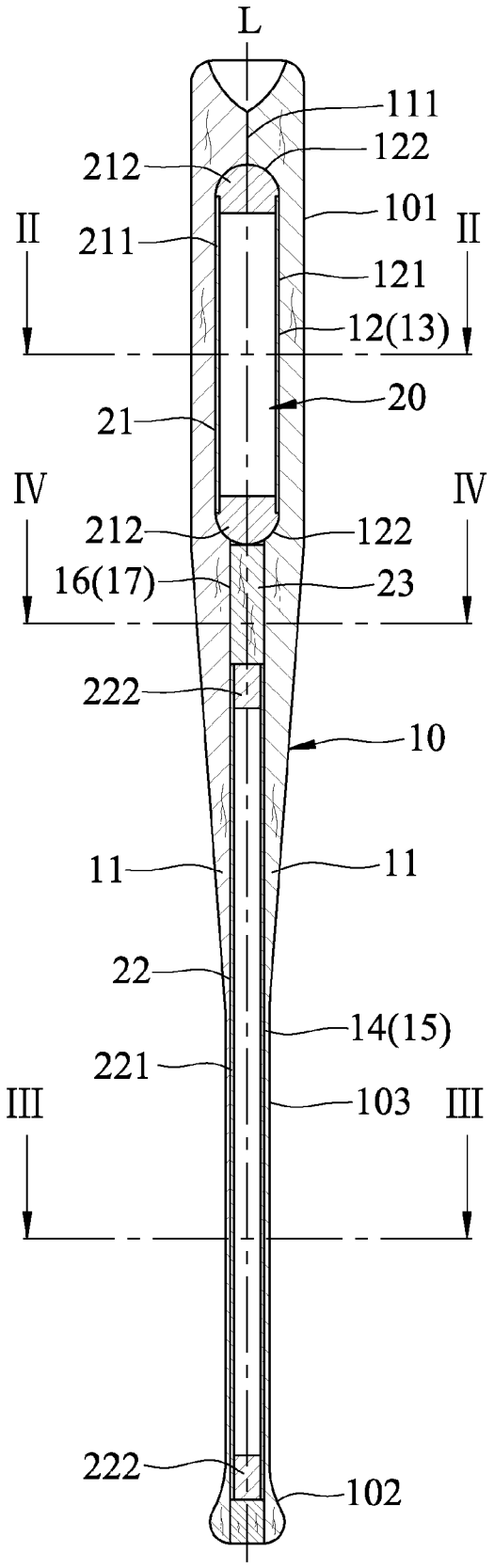
FIG. 1 is a sectional view of the preferred embodiment of a ball bat according to the invention.

Referring to FIG. 1, the preferred embodiment of a ball bat according to the present invention includes a bat body 10 and a core unit 20.

The bat body 10 extends along a main axis (L) and has a barrel section 101, a knob section 102 and a handle section 103. The barrel section 101 has an upper receiving space 12 that is defined by a first space-defining surface. The knob section 102 is opposite to the barrel section 101 along the main axis (L). The handle section 103 interconnects the barrel section 101 and the knob section 102 and has a lower receiving space 14 that is defined by a second space-defining space. In this embodiment, the bat body 10 further has an intermediate receiving space 16 that is defined by a third space-defining surface and that is disposed between the upper and lower receiving spaces 12, 14. To be specific, the upper, intermediate and lower receiving spaces 12, 16, 14 are arranged along the main axis (L) and are in spatial communication with one another.

Specifically, the bat body 10 is integrally formed by a plurality of angularly-disposed wooden pieces 11 extending along the main axis (L). Each of the wooden pieces 11 has a connecting region 111 that has a barrel part corresponding to the barrel section 101 of the bat body 10, a knob part corresponding to the knob section 102 of the bat body 10, and a handle part corresponding to the handle section 103 of the bat body 10. The barrel part of the connecting region 111 of each of the wooden pieces 11 is formed with an upper groove 112 (see FIG. 2) as a portion of the upper receiving space 12. The handle part of the connecting region 111 of each of the wooden pieces is formed with a lower groove 114 (see FIG. 3) as a portion of the lower receiving space 14. In this embodiment, the connecting region 111 of each of the wooden pieces 11 is further formed with an intermediate groove 116 (see FIG. 4) that is located between and in spatial communication with the upper and lower grooves 112,114 of the corresponding one of the wooden pieces 11 along the main axis (L) and that serves as a portion of the intermediate receiving space 16.

Figure 2:
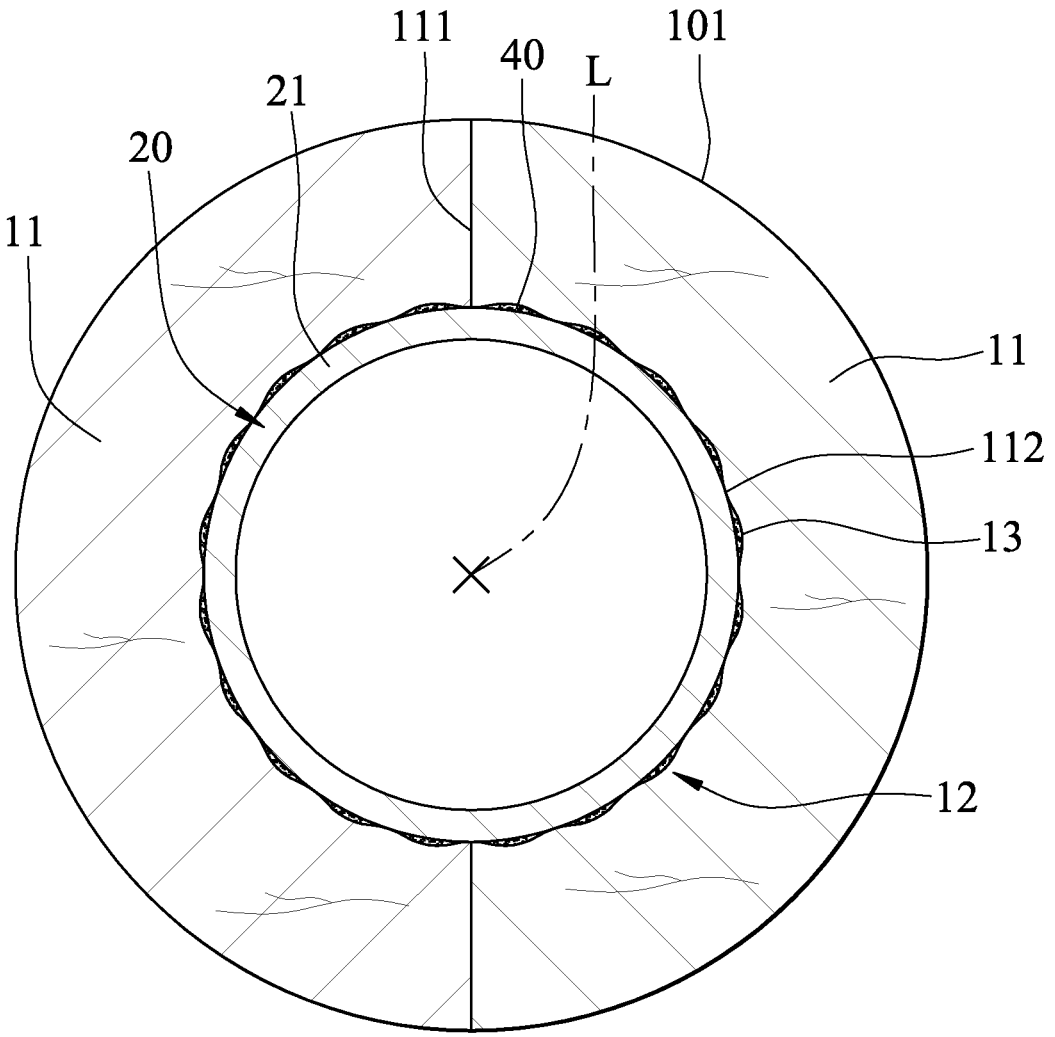
FIG. 2 is a sectional view of the preferred embodiment taken along line II-II in FIG. 1.
Figure 3:
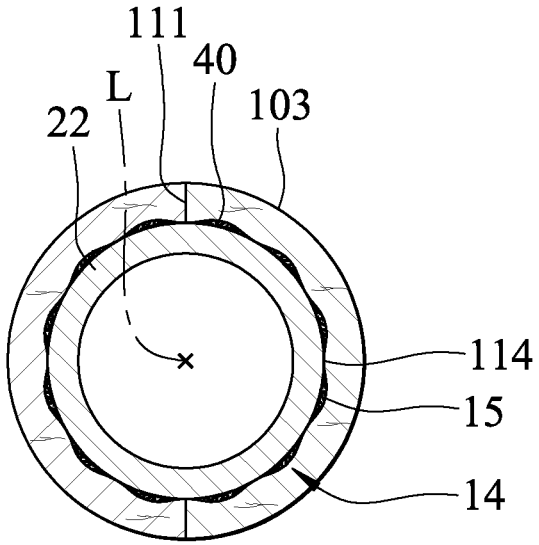
FIG. 3 is a sectional view of the preferred embodiment taken along line III-III in FIG. 1.
Figure 4:
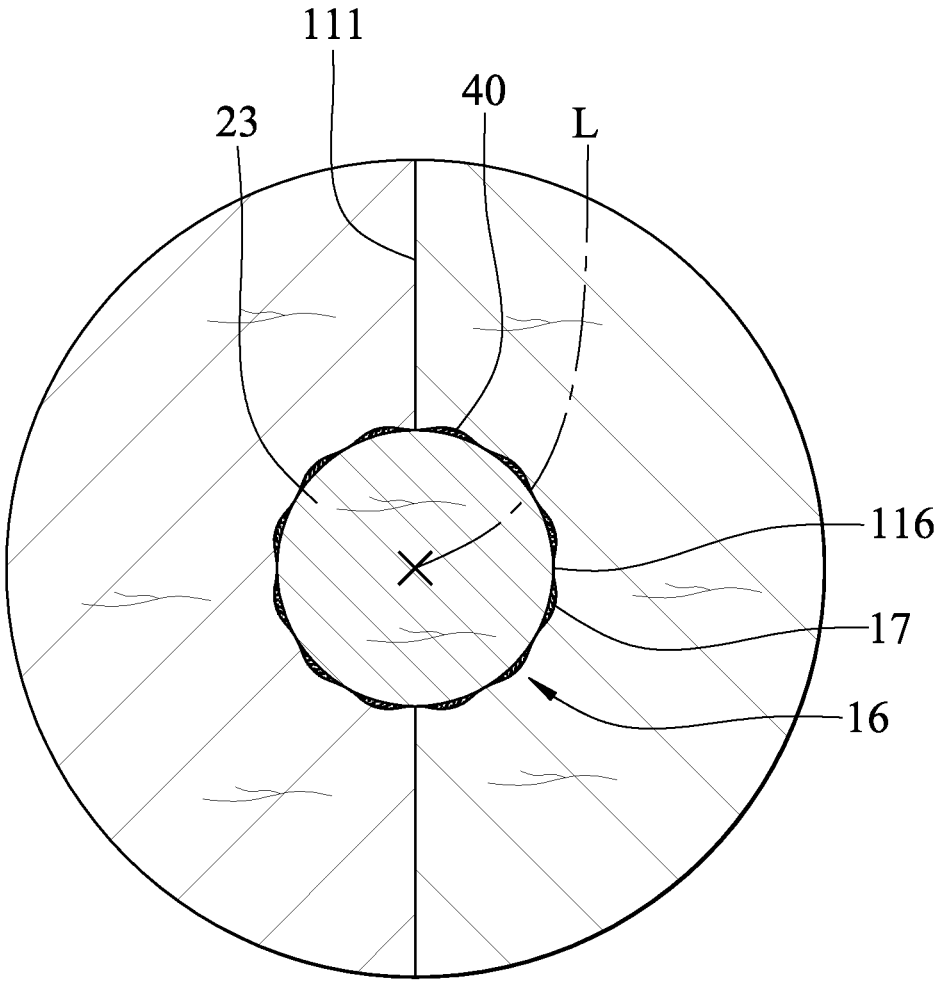
FIG. 4 is a sectional view of the preferred embodiment taken along line IV-IV in FIG. 1.

Further referring to FIGS. 2 to 4, in this embodiment, the number of the wooden pieces 11 is two, and the connecting region 111 of each of the wooden piece 11 is configured as a plane. Each of the wooden pieces 11 has a semi-circular cross-section, and each of the upper, intermediate and lower grooves 112, 116, 114 is a semi-circular groove. The upper groove 112 of each of the wooden pieces 11 has a depth that is larger than those of the intermediate and lower grooves 116, 114 of the corresponding one of the wooden pieces 11.

Each of the first, second and third space-defining surfaces is formed with a plurality of adhesive-receiving grooves 13, 15, 17 that are in spatial communication with a corresponding one of the upper, intermediate, and lower receiving spaces 12, 16, 14. In this embodiment, each of the adhesive-receiving grooves 13, 15, 17 is bordered by a curved U-shaped surface, but is not limited thereto (a V-shaped surface or a rectangular U-shaped surface may also apply).

The first space-defining surface includes a side surface portion 121 surrounding the main axis (L), and a pair of end surface portions 122 connected respectively to opposite ends of the side surface portion 121 along the main axis (L). Each of the end surface portions 122 of the first space-defining surface is configured as a hemispheric surface (see FIG. 1).

As shown in FIGS. 2 to 4, the core unit 20 is disposed in the bat body 10 and includes a first tube 21, a second tube 22, and an intermediate member 23. The first tube 21 of the core unit 20 is disposed in the upper receiving space 12 and is adhered to the first space-defining surface. In greater detail, the first tube 21 has a tubular body 211 extending along the main axis (L), and a pair of end plugs 212 that are respectively connected to opposite ends of the tubular body 211 along the main axis (L), and that respectively correspond in position to the end surface portions 122 of the first space-defining surface. The tubular body 211 of the first tube 21 is made of a carbon fiber material (or other composite materials), aluminum or other metals. The second tube 22 is disposed in the lower receiving space 14 and is adhered to the second space-defining surface. In greater detail, the second tube 22 has a tubular body 221 and a pair of side plugs 222 that are respectively connected to opposite ends of the tubular body 221 of the second tube 22. Each of the side plugs 222 of the second tube 22 has a flat end portion flush with a respective one of the opposite ends of the tubular body 221. The tubular body 221 of the second tube 22 is made of a carbon fiber material (or other composite materials), aluminum or other metals, and has an outer diameter that is smaller than that of the tubular body 211 of the first tube 21.

As shown in FIG. 4, the intermediate member 23 is disposed between the first and second tubes 21, 22 and in the intermediate receiving space 16. In this embodiment, the intermediate member 23 is made of wood (or other material) having a structural strength greater than those of the wooden pieces 11, and is configured as a solid cylindrical column.

Figure 5:
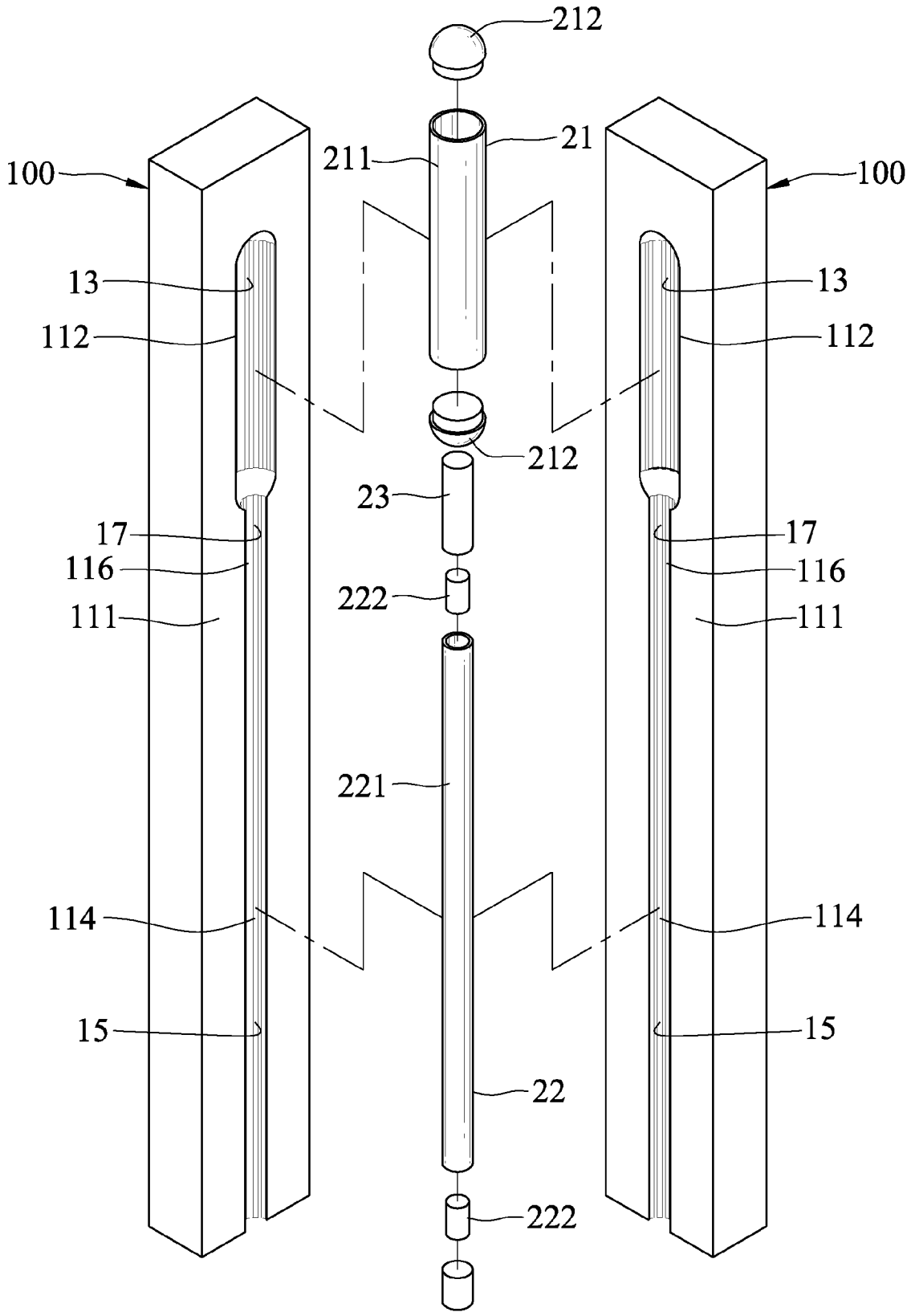
FIG. 5 is an exploded perspective view of a pair of raw wooden pieces and a core unit before being combined and shaped into the preferred embodiment.
Figure 6:
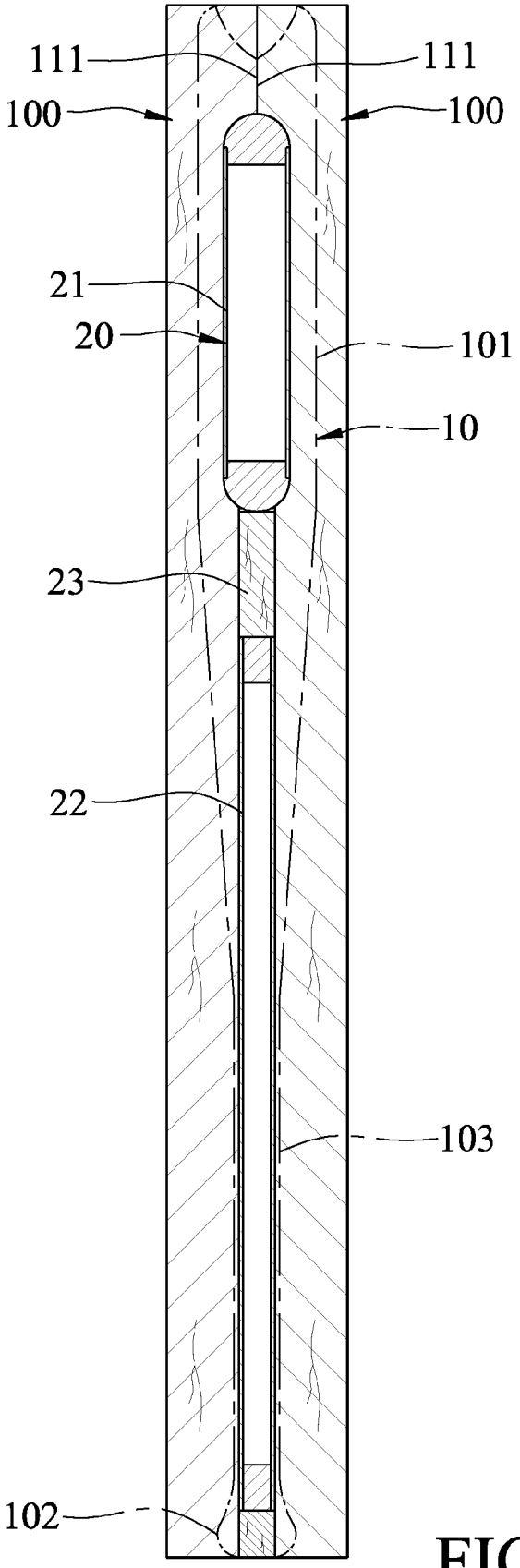
FIG. 6 is a sectional view of the raw wooden pieces combined with the core unit before being shaped into the preferred embodiment.

Referring to FIGS. 5 and 6, to make the preferred embodiment of the ball bat according to the present invention, a pair of raw wooden pieces 100 and the core unit 20 are prepared. Each of the raw wooden pieces 100 has the planar connecting region 111 that is formed with the upper groove 112, the intermediate groove 116, and the lower groove 114. Surfaces respectively defining the upper, intermediate, and lower groves 112, 116, 114 of each of the raw wooden pieces 100 are formed with the adhesive-receiving grooves 13, 17, 15, respectively. Subsequently, an adhesive 40 is applied into the upper, intermediate and lower grooves 112, 116, 114, or onto the first tube 21, the second tube 22 and the intermediate member 23. The first tube 21, the second tube 22, and the intermediate member 23 are then placed respectively into the upper groove 112, the lower groove 114, and the intermediate groove 116 of one of the raw wooden pieces 100, followed by combining the raw wooden pieces 100 through adhering the connecting regions 111 with each other and shaping the raw wooden pieces 100 into the wooden pieces 11 (see FIG. 6) so as to obtain the ball bat of the present invention.

To sum up, the preferred embodiment of the ball bat of the present invention has the following advantages:

(1) by utilizing the adhesive-receiving grooves 13, 15, 17, the adhesive 40 can be received therein so as to prevent leakage of the adhesive 40, as well as to allow the first tube 21, the intermediate member 23 and the second tube 22 to be fittingly and respectively received in the upper, intermediate and lower receiving spaces 12, 16, 14, resulting in better positioning of the first tube 21, the intermediate member 23, and the second tube 21, and in relatively good balance and hitting performance;

(2) the upper, intermediate and lower grooves 112, 116, 114 of each of the wooden pieces 11 are in spatial communication with one another along the main axis (L), so as to result in a simpler manufacturing process for the wooden pieces 11;

(3) the first tube 21 and the second tube 22 are spaced apart by the intermediate member 23, so that vibration of the first tube 21 generated upon hitting a ball is attenuated during transmission to the second tube 22, thereby reducing the discomfort of a holder while holding the ball bat; and (4) the center of gravity of the ball bat is adjustable by utilizing the intermediate member 23.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A ball bat comprising:

a bat body that extends along a main axis and that has a barrel section having an upper receiving space that is defined by a first space-defining surface, a knob section opposite to said barrel section along the main axis, and a handle section interconnecting said barrel section and said knob section, said bat body including a plurality of angularly-disposed wooden pieces that extend along the main axis, each of said wooden pieces having a connecting region that is formed with an upper groove as a portion of said upper receiving space, said first space-defining surface being formed with a plurality of adhesive-receiving grooves that are in spatial communication with said upper receiving space; and a core unit having a first tube disposed in said upper receiving space and adhered to said first space-defining surface;

wherein said first space-defining surface includes a side surface portion surrounding the main axis and a pair of end surface portions connected respectively to opposite ends of said side surface portion along the main axis, and said first tube of said core unit has a tubular body and a pair of end plugs that are respectively connected to opposite ends of said tubular body along the main axis and that correspond respectively in position to said end surface portions of said first space-defining surface.

2. The ball bat as claimed in claim 1, wherein said connecting region of each of said wooden pieces has a barrel part corresponding to said barrel section of said bat body and formed with said upper groove, a knob part corresponding to said knob section of said bat body, and a handle part corresponding to said handle section of said bat body.

3. The ball bat as claimed in claim 2, wherein:

said handle section of said bat body has a lower receiving space that is defined by a second space-defining surface;

said handle part of said connecting region of each of said wooden pieces of said bat body is formed with a lower groove as a portion of said lower-receiving space, said second space-defining surface being formed with a plurality of adhesive-receiving grooves that are in spatial communication with said lower receiving space; and said core unit further includes a second tube disposed in said lower receiving space and adhered to said second space-defining surface.

4. The ball bat as claimed in claim 3, wherein said bat body further has an intermediate receiving space disposed between said upper and lower receiving spaces, and said connecting region of each of said wooden pieces of said bat body is further formed with an intermediate groove that is located between said upper groove and said lower groove of a corresponding one of said wooden pieces and that serves as a portion of said intermediate receiving space.

5. The ball bat as claimed in claim 4, wherein:

said upper receiving space, said intermediate receiving space and said lower receiving space are arranged along the main axis;

said intermediate receiving space is in spatial communication with said upper and lower receiving spaces; and said core unit further includes an intermediate member disposed in said intermediate receiving space.

* * * * *